US009803372B2

(12) United States Patent
Griffiths et al.

(10) Patent No.: US 9,803,372 B2
(45) Date of Patent: Oct. 31, 2017

(54) NON-SEQUENTIALLY INSTALLED DRY JOINT WALL PANEL SYSTEM

(71) Applicant: Firestone Building Products Company, LLC., Indianapolis, IN (US)

(72) Inventors: Robert T. Griffiths, Elk River, MN (US); Wayne M. Wagner, West St. Paul, MN (US); Ryan Longtin, Anoka, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 0 days.

(21) Appl. No.: 14/973,049

(22) Filed: Dec. 17, 2015

(65) Prior Publication Data

US 2016/0102462 A1 Apr. 14, 2016

Related U.S. Application Data

(63) Continuation of application No. PCT/US2014/045852, filed on Jul. 9, 2014.
(Continued)

(51) Int. Cl.
*E04F 13/08* (2006.01)
*E04F 13/12* (2006.01)
(Continued)

(52) U.S. Cl.
CPC ..... *E04F 13/0862* (2013.01); *E04F 13/083* (2013.01); *E04F 13/0889* (2013.01);
(Continued)

(58) Field of Classification Search
CPC . E04F 13/0862; E04F 13/083; E04F 13/0889; E04F 13/12; E04F 13/18
See application file for complete search history.

(56) References Cited

U.S. PATENT DOCUMENTS 5,226,274 A * 7/1993 Sommerstein ..... E04F 13/0805 52/509
6,226,947 B1 * 5/2001 Bado ..... E04F 13/0805 52/235

(Continued)

FOREIGN PATENT DOCUMENTS

JP 06-48041 Y2 12/1994
KR 10-2011-0112039 A 10/2011
KR 20-2013-0003970 U 7/2013

OTHER PUBLICATIONS

International Preliminary Report on Patentability dated Jan. 12, 2016 for International Application No. PCT/US2014/045852 (9 pages).

*Primary Examiner* — Paola Agudelo
(74) *Attorney, Agent, or Firm* — Taylor IP, P.C.

(57) ABSTRACT

A wall panel system for attachment to a building surface includes a plurality of generally vertical supports, and a plurality of generally horizontal mounting rails interconnected with the vertical supports to define a panel mounting gridwork. The horizontal mounting rails have an upper mounting feature and a lower mounting feature, on a side opposite from the building surface. A plurality of panels each have a rear surface, an upper extrusion mounted to a top of the rear surface, and a lower extrusion mounted to a bottom of the rear surface. The upper extrusion mates with a corresponding lower mounting feature on the gridwork, and the lower extrusion mates with a corresponding upper mounting feature on the gridwork. The plurality of panels have a gap about a periphery thereof relative to any adjacent panels, whereby the panels can be non-sequentially mounted to the gridwork.

15 Claims, 14 Drawing Sheets

Related U.S. Application Data

(60) Provisional application No. 61/844,148, filed on Jul. 9, 2013.

(51) Int. Cl.
*E04F 13/18* (2006.01)
*E04F 13/22* (2006.01)

(52) U.S. Cl.
CPC ..... *E04F 13/12* (2013.01); *E04F 13/18* (2013.01); *E04F 13/22* (2013.01)

(56) References Cited

U.S. PATENT DOCUMENTS

| | | | | |
|---|---|---|---|---|
| 7,621,084 | B2 * | 11/2009 | Bilge | E04F 13/0814 52/235 |
| 8,127,507 | B1 * | 3/2012 | Bilge | E04F 13/0814 52/235 |
| 8,166,716 | B2 * | 5/2012 | Macdonald | E04F 13/0826 52/235 |
| 8,336,273 | B2 * | 12/2012 | Enns | E04F 13/081 52/302.1 |
| 2007/0022682 | A1 * | 2/2007 | Morgenegg | E04F 13/0889 52/235 |
| 2009/0241444 | A1 * | 10/2009 | Griffiths | E04F 13/0889 52/235 |
| 2009/0313928 | A1 * | 12/2009 | Montgomery | E04F 13/081 52/309.1 |
| 2012/0017530 | A1 * | 1/2012 | Hummel, III | E04F 13/081 52/506.05 |
| 2012/0304573 | A1 | 12/2012 | Aboukhalil | |

* cited by examiner

NON-SEQUENTIALLY INSTALLED DRY JOINT WALL PANEL SYSTEM

This is a continuation of PCT application No. PCT/US2014/045852, entitled "NON-SEQUENTIALLY INSTALLED DRY JOINT WALL PANEL SYSTEM", filed Jul. 9, 2014, which claims priority from U.S. provisional patent application Ser. No. 61/844,148, entitled "NON-SEQUENTIALLY INSTALLED DRY JOINT WALL PANEL SYSTEM", filed Jul. 9, 2013, which are incorporated herein by reference.

BACKGROUND OF THE INVENTION

1. Field of the Invention

The present invention relates to an architectural wall panel system designed to cover an interior or exterior building surface.

2. Description of the Related Art

Architectural wall panel systems, including both metal and composite wall panel systems, have been used extensively for some time, primarily in the commercial and industrial building markets. In recent years the popularity of composite wall panel systems, in particular, has been increasing steadily. There are a number of factors that may be credited for the wide-spread and increased use of such wall panel systems. One such factor is the high cost to construct commercial and industrial buildings, which tend to be relatively large, from stone or brick. Wood is not a suitable substitute due to the large loads the buildings supporting structure must withstand. Another factor affecting the increased use of metal and composite wall panel systems is the high durability of the systems. Both the metals and composites used to make the panels for wall panel systems are highly resistant to damage from sun, dirt, moisture, fire, and many other environmental elements. Consequently, the metal and composite wall panel systems have a long life, and may require less maintenance than other alternative building materials and systems.

Architectural wall panel systems can generally be placed into one of two categories: face-sealed architectural panel systems or vented rain-screen architectural panel systems. Face-sealed architectural panel systems include those systems that include a sealant in both the horizontal and vertical joints between adjacent wall panels. The sealants make the wall panel system impermeable to air and water, and may include caulking, gaskets, or other sealants with a similar function. Vented rain-screen architectural panel systems are those systems designed to allow permeability through the joints between adjacent wall panels. The permeable joints allow for breathability and rapid pressure equalization within the wall panel system to prevent pressure buildups behind the wall panels.

Architectural wall panel systems have many advantages, as discussed above, however, these systems may also present a number of challenges and disadvantages. For example, a disadvantage associated with many architectural wall panel systems is the complexity of the system, including the number of pieces and parts needed and the extensive time and labor required to install the complex system. In particular, where a form of attachment clips are used to secure the wall panels to the substructure, each clip must typically be fastened to the wall panel and to the substructure, either directly or indirectly. This means that if an extremely high number of fasteners are used, it results in a great deal of time and effort spent in installation of the systems just to secure the clips to the panels prior to attaching the panels to the structure.

A number of different attachment systems have been introduced and employed in an attempt to overcome the challenges and alleviate the disadvantages discussed above. One known attachment system includes a plurality of locking members secured directly to, or formed integrally with, the outer surface of the return flanges of wall panels. The locking members secure the panel to a retaining member, which is itself secured to a surface of a building structure. The locking members are shaped such that they may be forced into a channel, but cannot be removed from that channel, such as angled surfaces with an apex adjacent the retaining member that resemble half of an arrowhead. The system may also optionally provide a drainage channel to carry water and other debris away from the surface of the building structure. While this attachment system allows for more efficient installation of an architectural wall panel system, it suffers from the disadvantage mentioned above relating to thermal cycling of the wall panel system because it does not allow for movement of the wall panels. In addition, the attachment system suffers from a number of new disadvantages, such as not providing adequate attachment strength to withstand some natural weather conditions, and making it extremely difficult to repair or replace installed wall panels as the locking members prevent the panel from being removed from the retaining members.

Other known attachment systems for securing wall panels of an architectural wall panel system to a building surface utilize some form of an insert wedged between the two adjacent flanges of adjacent wall panels, while the flanges are received in a channel. The insert is secured between the two flanges by a fastener, and fits snuggly therebetween to provide a seal against water and air infiltration. The insert may be made of an elastomeric material to allow for thermal expansion and contraction of the wall panels. This system, however, uses a high number of parts, and the thermal cycling of the system is limited by the small amount of movement allowed by the elastomeric insert. Furthermore, the elastomeric insert is subject to wear from the natural elements it will be exposed to, and subject to failure due to these elements and repeated expansion and contraction as a result of the thermal cycling of the wall panel system.

Additional attempts at improved attachment systems have included attachment systems utilizing variously shaped flanges extending along at least one edge of the wall panel to facilitate attachment of the panel to a building surface; attachment systems using rotatable retaining members secured to the mounting surface that rotate between a first (narrow) position designed to allow placement of the wall panels and a second (broad) position extending into slots in the wall panel flange to secure the panel in place, such as, for example, a T-shaped retaining member that rotates about an axis parallel to the wall panel flanges; and attachment systems having vents and filler strips which slide into grooves and are positioned within the gaps between adjacent wall panels to provide a watertight seal while allowing air flow therethrough. None of these attachment systems has proven noticeably advantageous over conventional attachment methods in providing a more efficient, reliable, and practical means of attaching architectural wall panels to the surface of a structure.

There is therefore a need for an improved architectural wall panel system, and specifically an improved attachment system for attaching architectural wall panels, that alleviates one or more of the disadvantages discussed herein.

SUMMARY OF THE INVENTION

The present invention provides a wall panel system that is built using panels mounted to mounting rails on a gridwork such that a gap is formed between adjacent panels, allowing the panels to be mounted non-sequentially.

The invention in one form is directed to a wall panel system for attachment to a building surface. The wall panel system includes a plurality of generally vertical supports, and a plurality of generally horizontal mounting rails interconnected with the vertical supports to define a panel mounting gridwork. The horizontal mounting rails have an upper mounting feature and a lower mounting feature, on a side opposite from the building surface. A plurality of panels each have a rear surface, an upper extrusion mounted to a top of the rear surface, and a lower extrusion mounted to a bottom of the rear surface. The upper extrusion mates with a corresponding lower mounting feature on the gridwork, and the lower extrusion mates with a corresponding upper mounting feature on the gridwork. The plurality of panels have a gap about a periphery thereof relative to any adjacent panels, whereby the panels can be non-sequentially mounted to the gridwork.

The invention in another form is directed to a method of building a wall panel system on a panel mounting gridwork including a plurality of mounting rails, each said mounting rail including a lower mounting feature and an upper mounting feature, including the steps of providing a plurality of panels, each panel having a rear surface, an upper extrusion mounted to a top of the rear surface, and a lower extrusion mounted to a bottom of the rear surface. A first panel is mounted to a first mounting rail and a second mounting rail adjacent to the first mounting rail on the gridwork. A second panel is mounted to the second mounting rail such that a gap is formed between the first panel and the second panel and the mounting steps can be performed non-sequentially.

An advantage of the present invention is that the panels can be mounted to the gridwork in any order desired.

Another advantage is that the panels can be hung upon the gridwork without using any tools.

Yet another advantage is that the extrusions of the panels can be identical to reduce the cost of producing the panels.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
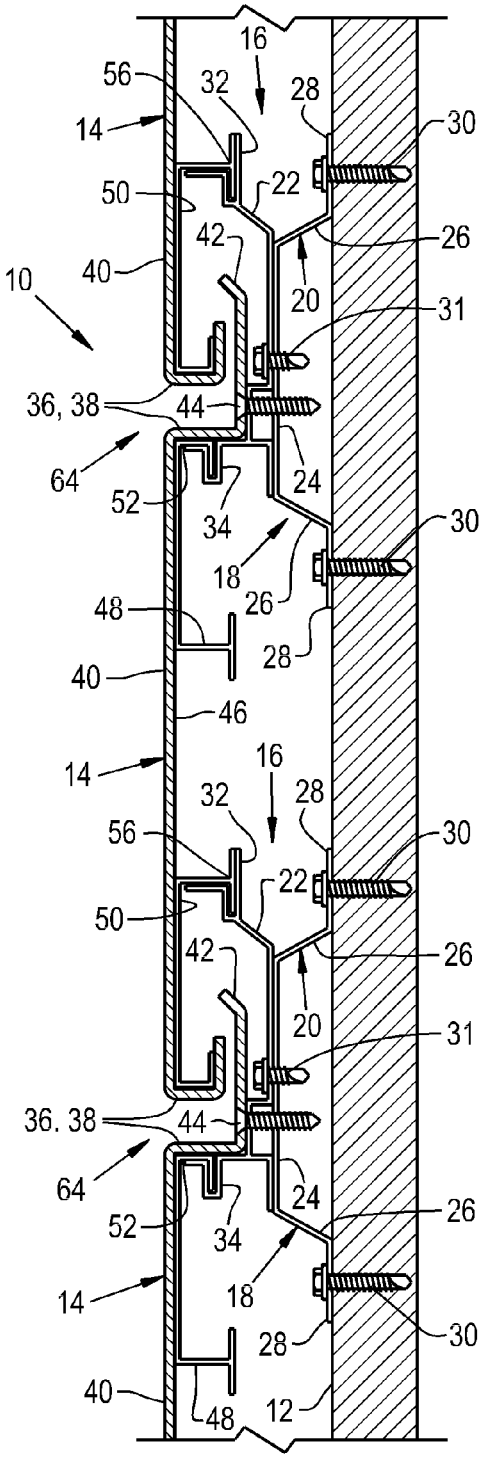
FIG. 1 is a cross-sectional view of an embodiment of the present invention.
Figure 2:
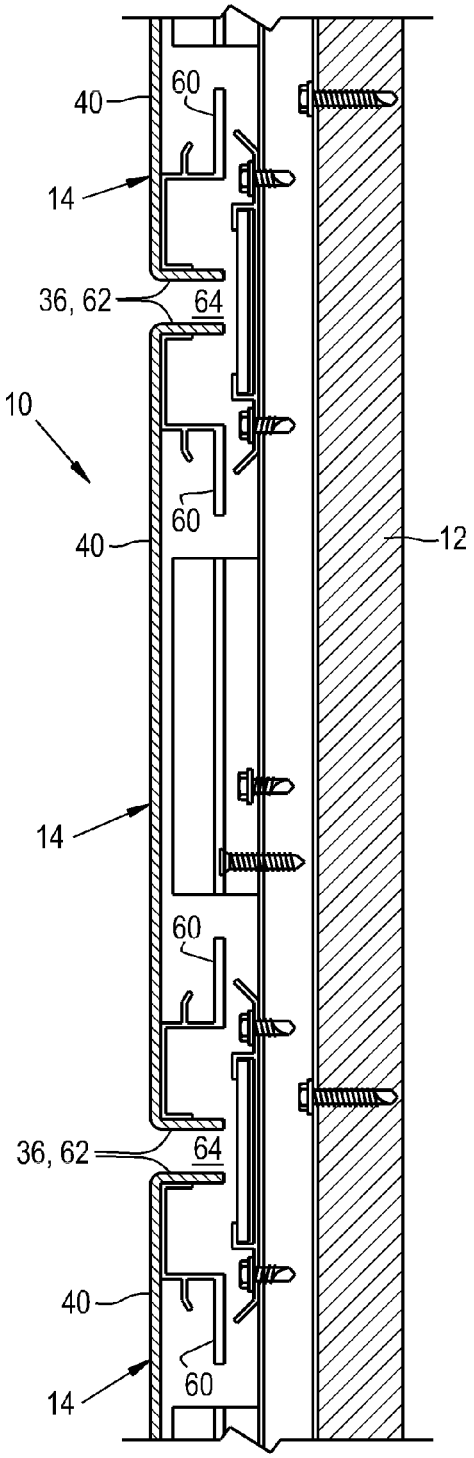
FIG. 2 is a cross-sectional view of the embodiment shown in FIG. 1 taken along a line perpendicular to the view shown in FIG. 1.
Figure 3:
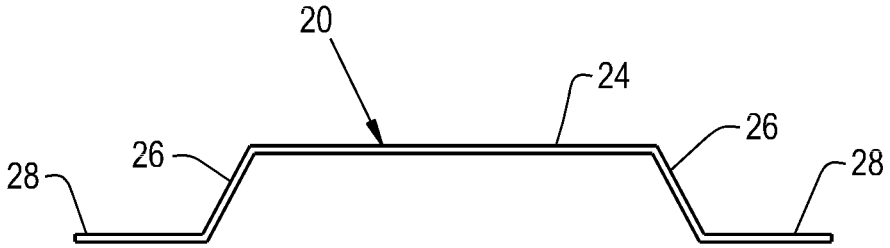
FIG. 3 is a cross-sectional view of an extrusion of a mounting rail shown in FIGS. 1 and 2.

Referring now to the drawings, and more particularly to FIGS. 1-8, there is shown an embodiment of a wall panel system 10 according to the present invention. Wall panel system 10 is preferably configured as a rain screen that can be used as an external wall panel system for a building, but can also be used as an internal wall panel system.

Wall panel system 10 is attached to a building surface 12, such as an external wall. Wall panel system 10 generally includes wall panels 14 which are attached to building surface 12 via an attachment system 16. Attachment system 16 includes generally horizontal mounting rails 18 formed from a pair of extrusions 20 and 22. Extrusions 20 include a planar surface 24 that is generally parallel to building surface 12, and a pair of legs 26 extending between planar surface 24 and building surface 12. Extrusions 20 also include a pair of mounting flanges 28, with each mounting flange 28 extending outwardly from an end of a leg 26 opposite planar surface 24. Mounting flanges 28 are secured to building surface 12 by a plurality of fasteners 30 through mounting flanges 28. Fasteners 30 may be any conventional fasteners known to those skilled in the art. In the illustrated embodiment, fasteners 30 are self-drilling fasteners so that they may be installed through mounting flanges 28 and building surface 12 without the need for pre-drilling holes. Mounting rails 18 are shown directly attached to building surface 12, but may also be attached to vertical studs (not shown) and indirectly attached to building surface 12.

Extrusions 22 are attached to extrusions 20 using suitable fasteners, such as self-tapping screws 31. Extrusions 22 include an upper mounting feature 32 and a lower mounting feature 34 on a side opposite from building surface 12. Each of upper mounting feature 32 and a lower mounting feature 34 define a recess which mates with a corresponding feature on a respective wall panel 14, described in more detail below.

Wall panels 14 each have a return flange 36 about a periphery 38 thereof. Return flanges 36 extend at an approximate 90° angle relative to an outer surface 40 which is the primary visible surface when wall panels 14 are installed in place within wall panel system 10. At the top of each wall panel 14 is a vertical extension plate 42 which extends upward from and curves slightly behind a bottom return flange 36 of an adjacent wall panel 14. Optional screws 44 may be used to attach vertical extension plate 42 with each of extrusions 20 and 22. Wall panels 14 also include a rear surface 46 on a side opposite from outer surface 40.

An upper extrusion 48 is mounted to a top of rear surface 46, adjacent to return flange 36. Similarly, a lower extrusion 50 is mounted to a bottom of rear surface 46, adjacent to return flange 36. Upper extrusion 48 mates with a corresponding lower mounting feature 34 of a mounting rail 18 at the top of wall panel 14, and lower extrusion 50 mates with a corresponding upper mounting feature 32 of a mounting rail 18 at the bottom of wall panel 14.

Figure 4:
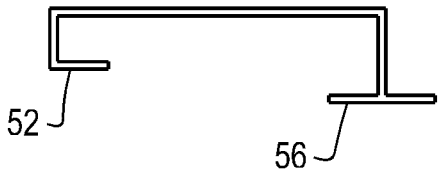
FIG. 4 is a cross-sectional view of an upper extrusion shown in FIGS. 1 and 2.
Figure 5:
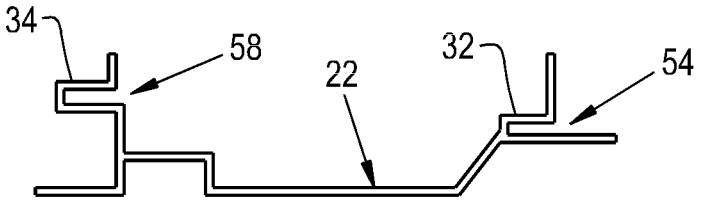
FIG. 5 is a cross-sectional view of another extrusion of a mounting rail shown in FIGS. 1 and 2.

More particularly, upper extrusion 48 includes a projection 52 which mates with a corresponding recess 54 defined by lower mounting feature 34. Similarly, lower extrusion 50 includes a projection 56 which mates with a corresponding recess 58 defined by upper mounting feature 32 (FIGS. 1 and 4).

Figure 23:
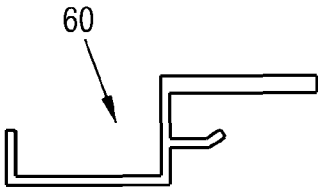
FIG. 23 is a cross-sectional view of a side extrusion shown in FIGS. 2 and 7.
Figure 24:
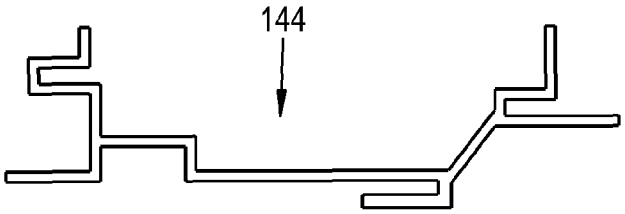
FIG. 24 is a cross-sectional view of an extrusion of a mounting rail shown in FIG. 21.
Figure 25:
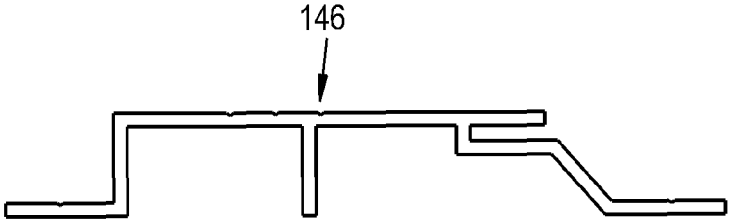
FIG. 25 is a cross-sectional view of another extrusion of a mounting rail shown in FIG. 21.

In the illustrated embodiment, upper extrusion 48 and lower extrusion 50 are substantially identical, which reduces manufacturing costs. Additionally, referring to FIG. 2, a pair of side extrusions 60 (shown in greater detail in FIG. 23) are mounted to respective side edges 62 of wall panel 14. Side extrusions 60 are shown with a cross section which is different from extrusions 48 and 50. However, extrusions 60 may also have a cross section which is identically configured to upper extrusion 48 and lower extrusion 50, which further reduces manufacturing costs.

To install wall panels 14, each wall panel 14 is positioned relative to mounting rails 18 such that upper extrusion 48 is positioned above a selected lower mounting feature 34, and lower extrusion 50 is positioned above a corresponding selected upper mounting feature 32. Wall panel 14 is then moved in a downward direction until upper extrusion 48 mates with lower mounting feature 34 and lower extrusion 50 mates with upper mounting feature 32. When installed, a gap 64 exists about the periphery of each wall panel 14, thereby allowing wall panels 14 to be non-sequentially installed on wall panel system 10. Wall panel system 10 provides a pressure equalized rain screen, which is quick and easy to install without the use of tools (although optional screws 44 may be used, if desired).

Figure 6:
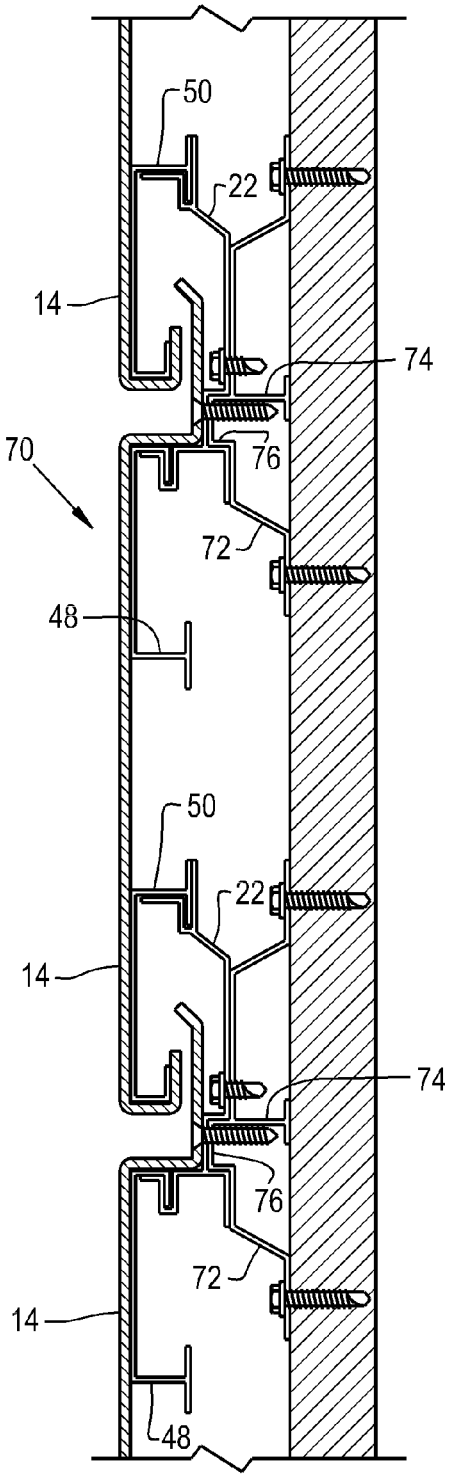
FIG. 6 is a cross-sectional view of another embodiment of the present invention.
Figure 7:
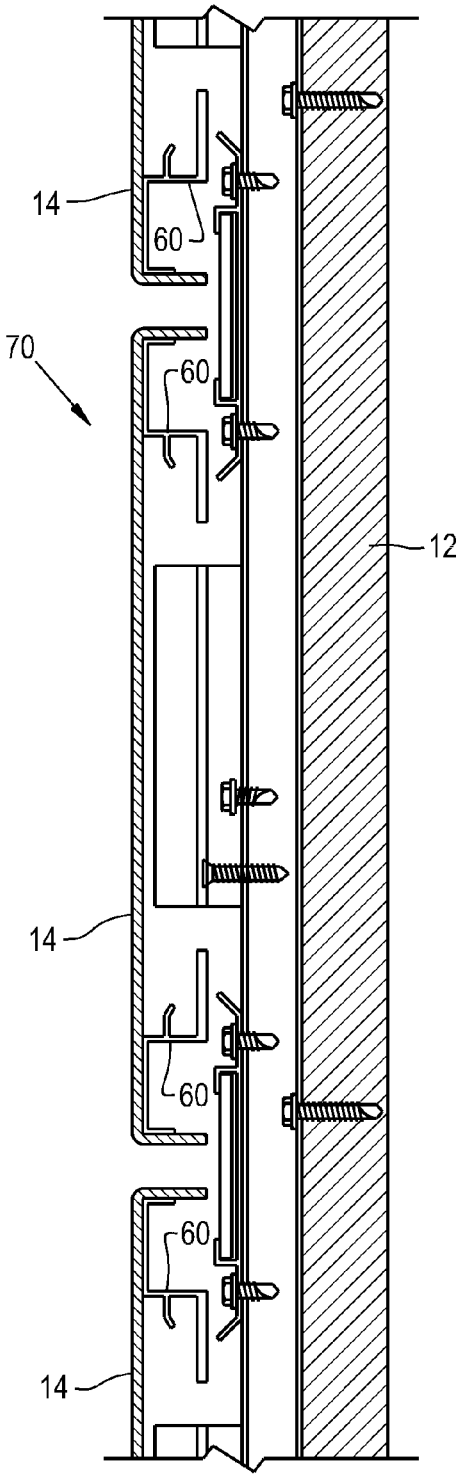
FIG. 7 is a cross-sectional view of the embodiment shown in FIG. 6 taken along a line perpendicular to the view shown in FIG. 6.
Figure 8:
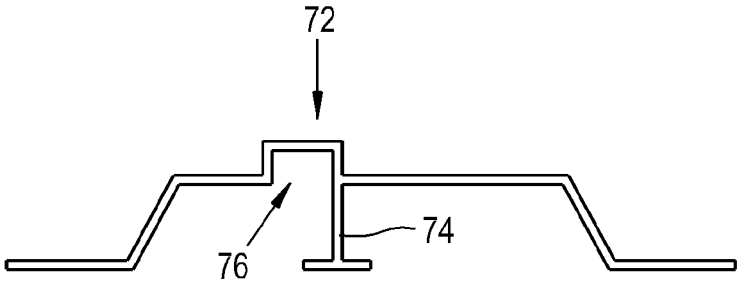
FIG. 8 is a cross-sectional view of an extrusion shown in FIGS. 6 and 7.
Figure 9:
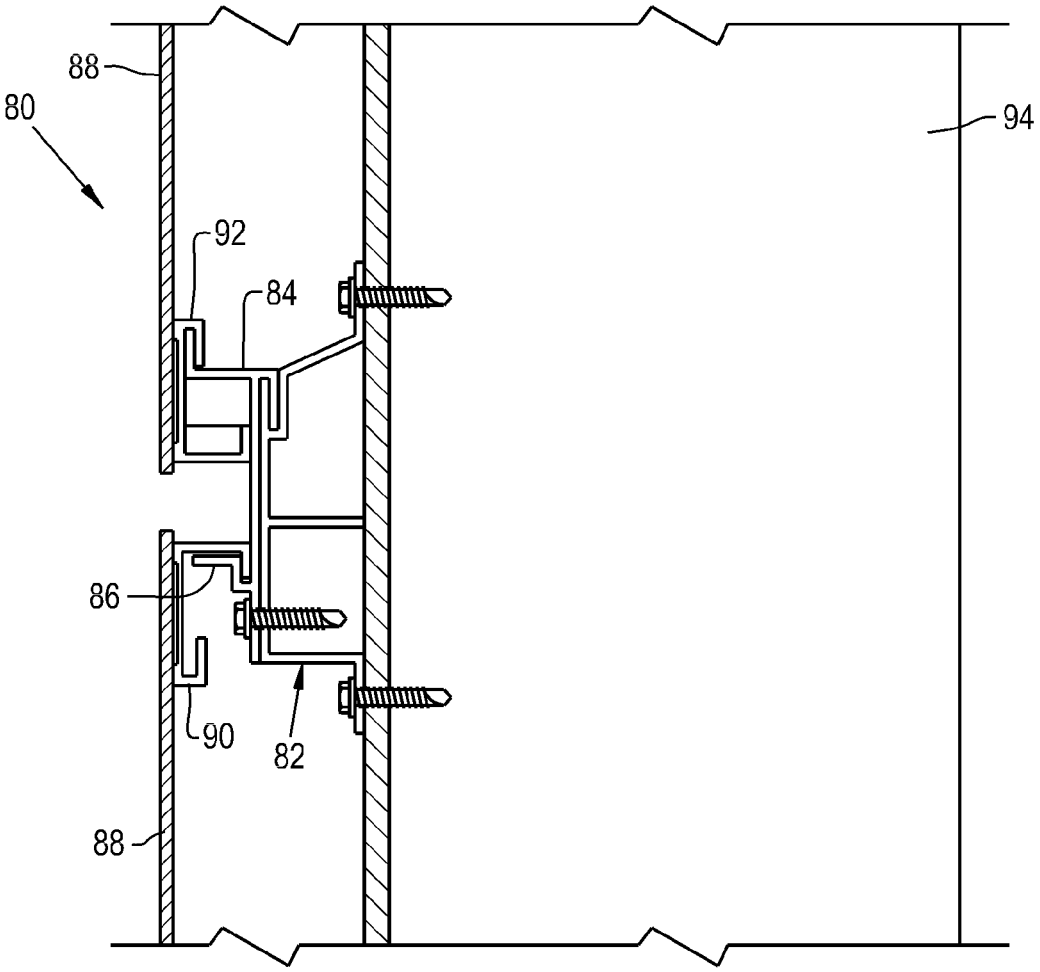
FIG. 9 is a cross-sectional view of yet another embodiment of the present invention.
Figure 10:
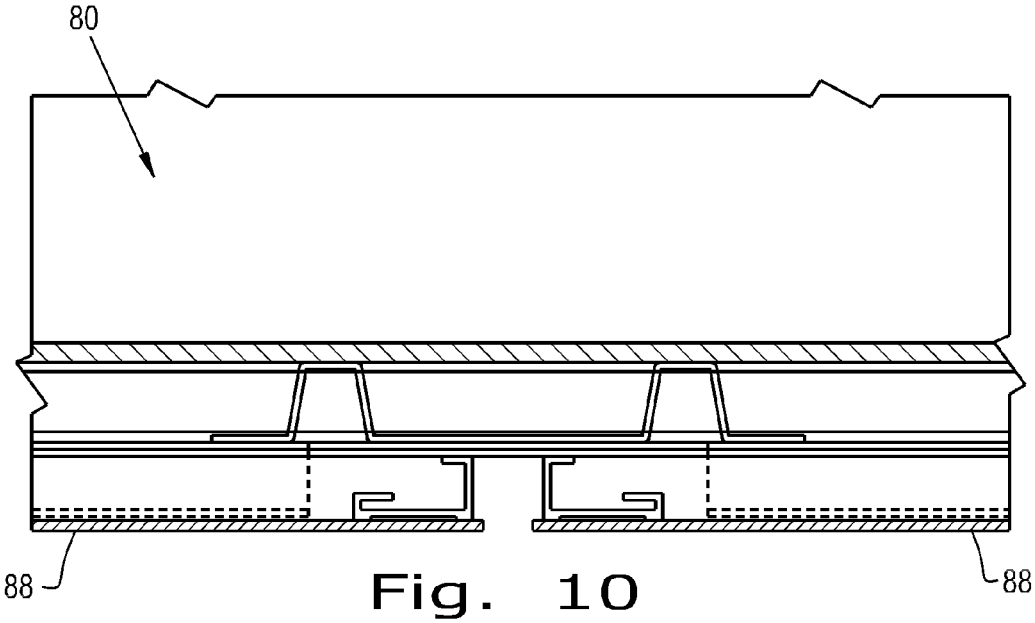
FIG. 10 is a cross-sectional view of the embodiment shown in FIG. 9 taken along a line perpendicular to the view shown in FIG. 9.

Referring now to FIGS. 6-8, another embodiment of a wall panel system 70 of the present invention is shown. Wall panel system 70 is similar to wall panel system 10 shown in FIGS. 1-5, and includes extrusion 22, upper extrusion 48, lower extrusion 50 and side extrusions 60. Wall panel system 70 differs from wall panel system 10 in that an extrusion 72 is attached to building surface 12, rather than an extrusion 20. Extrusion 72 includes a standoff 74 which abuts building surface 12, and also has an additional contoured shape 76 which complements the adjacent contour of extrusion 22.

Figure 11:
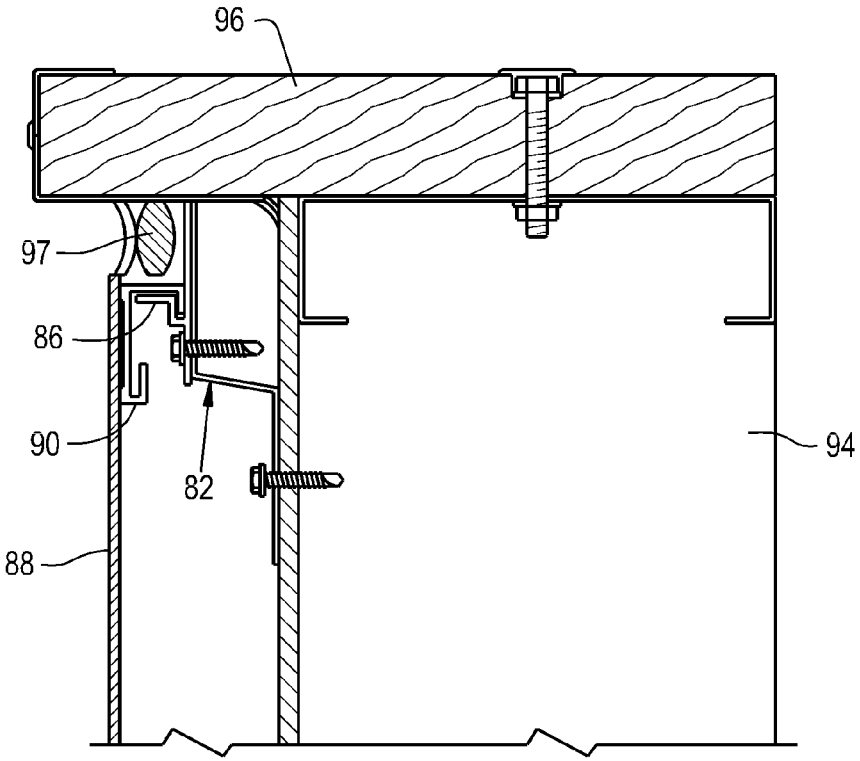
FIG. 11 is a cross-sectional view of a panel shown in FIGS. 9 and 10 adjacent to a ceiling.
Figure 12:
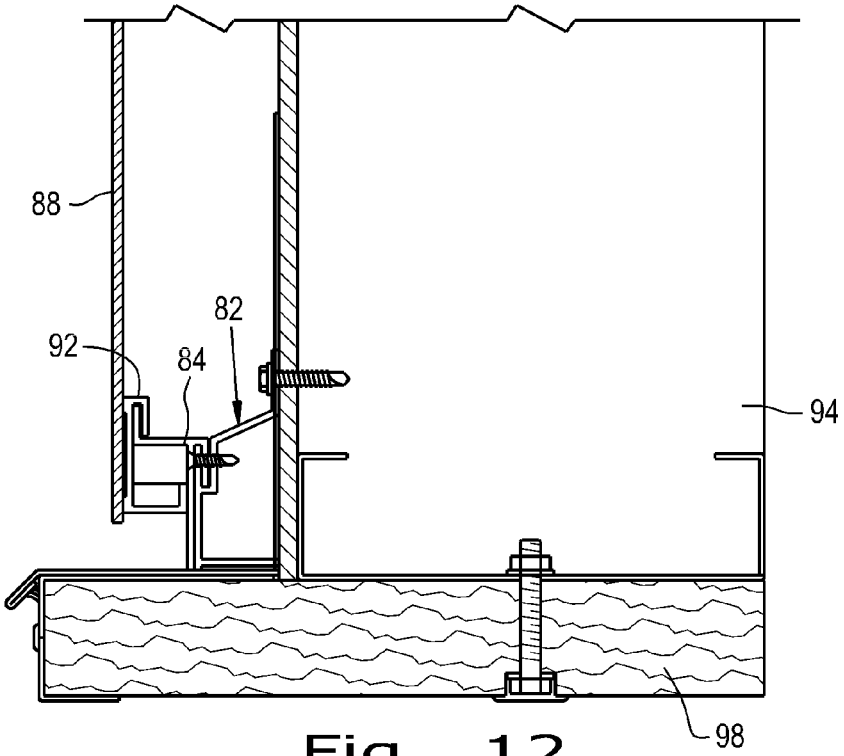
FIG. 12 is a cross-sectional view of a panel shown in FIGS. 9 and 10 adjacent to a floor.
Figure 13:
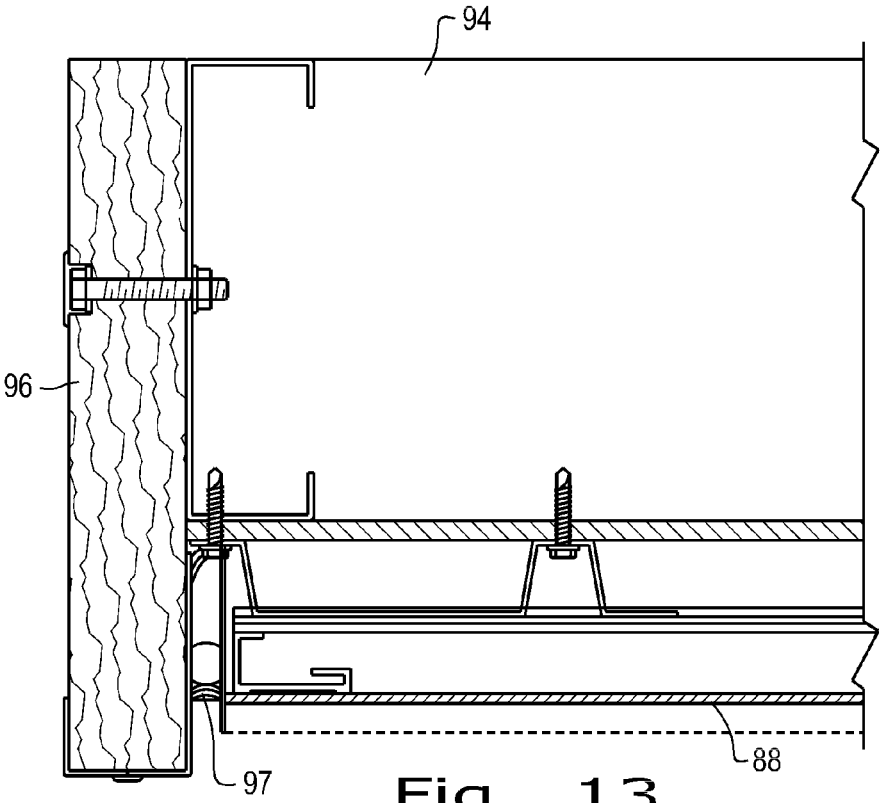
FIG. 13 is a cross-sectional view of the panel shown in FIG. 11 taken along a line perpendicular to the view shown in FIG. 11.

Referring now to FIGS. 9-13, there is shown another embodiment of a wall panel system 80 of the present invention. Wall panel system 80 is similar to wall panel system 10 shown in FIGS. 1-5, in that it includes a generally horizontal mounting rail 82 defining an upper mounting feature 84 and a lower mounting feature 86. Each wall panel 88 likewise includes an upper extrusion 90 and a lower extrusion 92 which respectively mate with lower mounting feature 86 and upper mounting feature 84. Mounting rails 82 are mounted to studs 94, which in turn are mounted to the building surface 12 (not shown). As can be seen in FIGS. 11 and 12, the mounting rails 82 can be shortened to accommodate attaching the panels 88 near a ceiling 96 (shown in FIG. 11) or a floor 98 (shown in FIG. 12). When attaching a panel 88 near the ceiling 96, a filler 97 can be placed between the panel 88 and ceiling 96, where a gap would normally be formed, if desired. While FIG. 12 does not show a filler placed in an equivalent gap between the panel 88 and the floor 98, one could also be placed there if desired.

Figure 14:
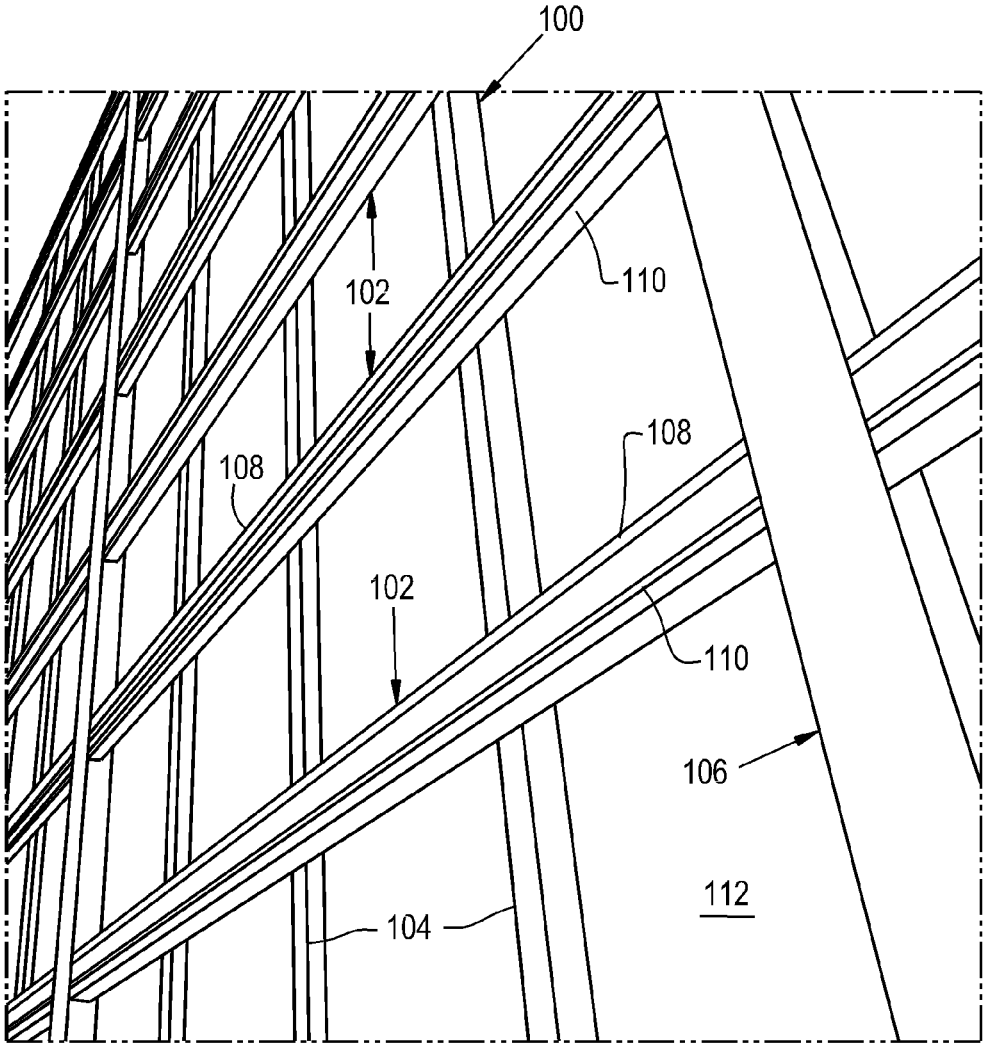
FIG. 14 is a perspective view of yet another embodiment of the present invention.
Figure 15:
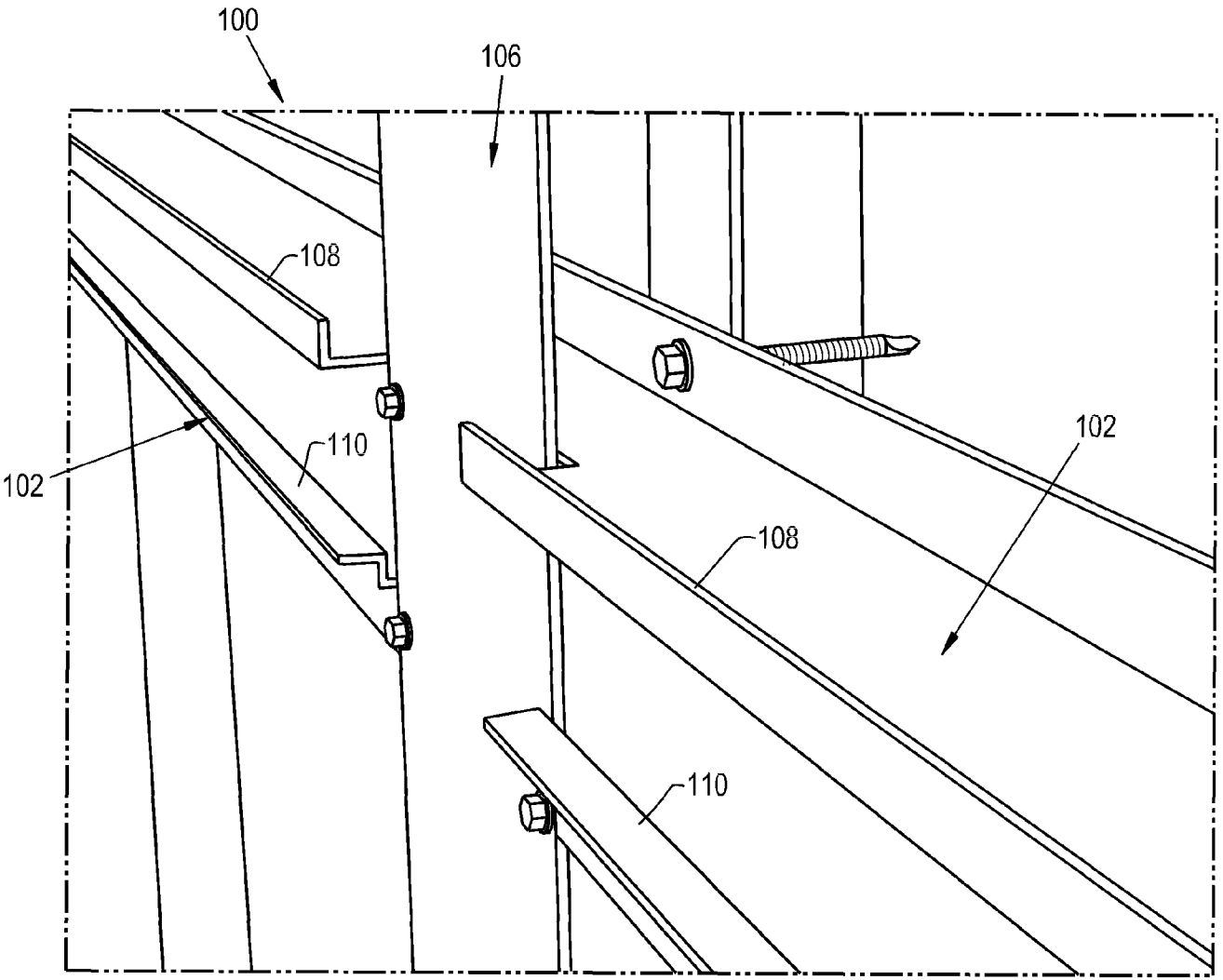
FIG. 15 is another perspective view of the embodiment shown in FIG. 14.
Figure 16:
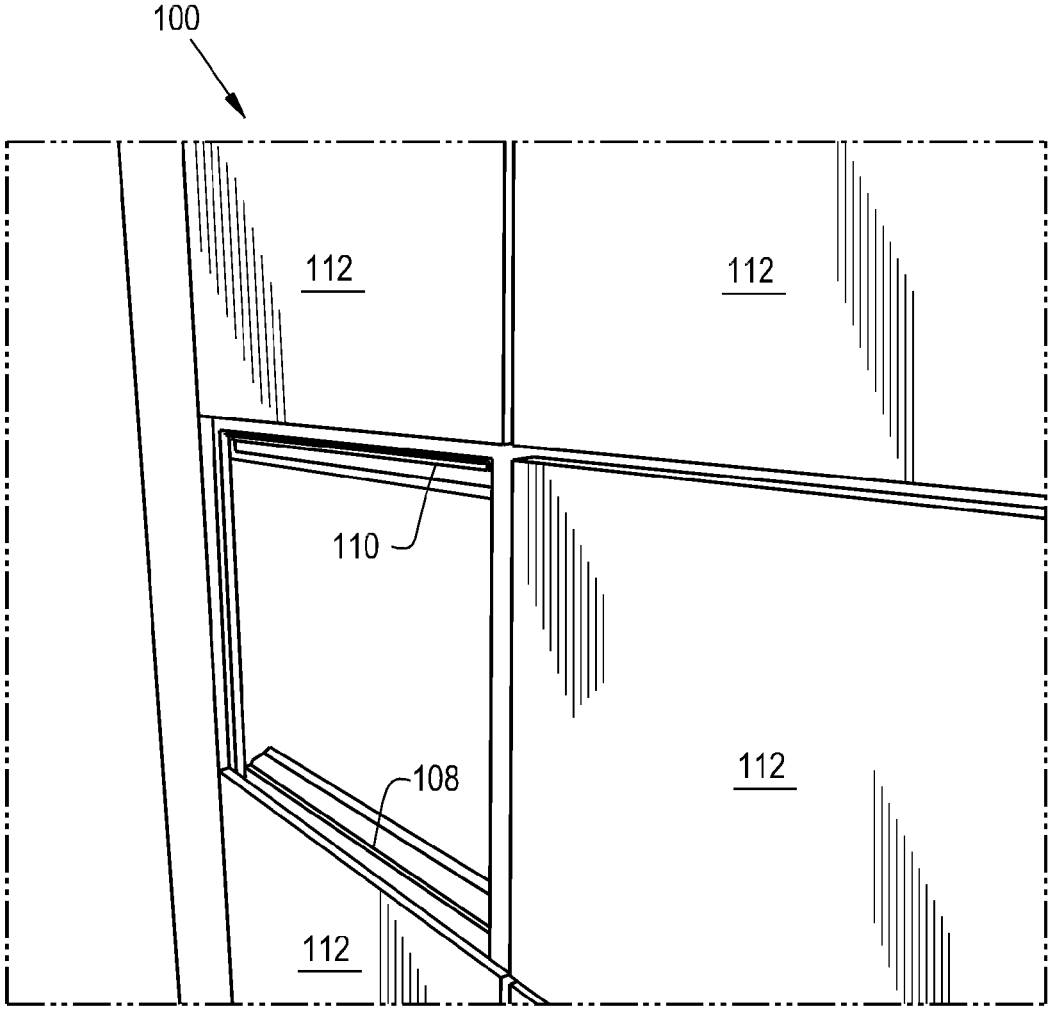
FIG. 16 is yet another perspective view of the embodiment shown in FIGS. 14 and 15.
Figure 17:
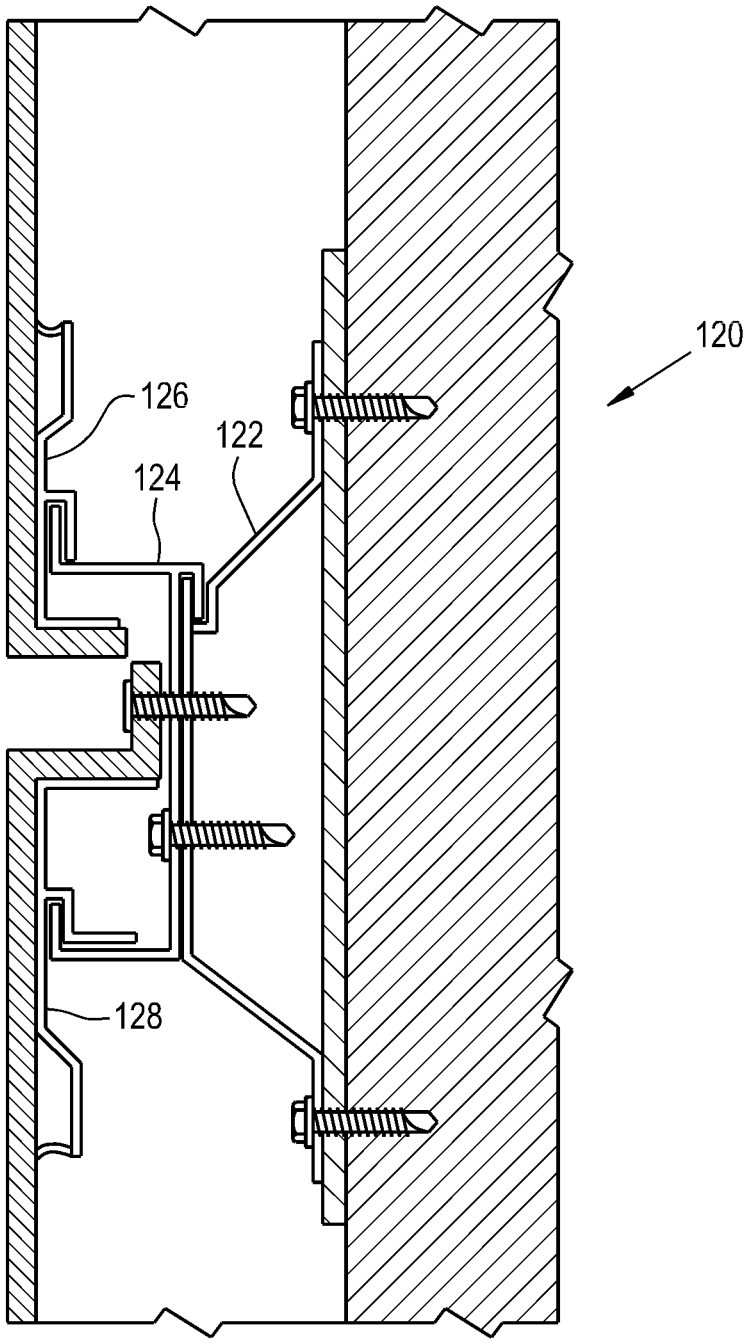
FIG. 17 is a cross-sectional view of yet another embodiment of the present invention.
Figure 18:
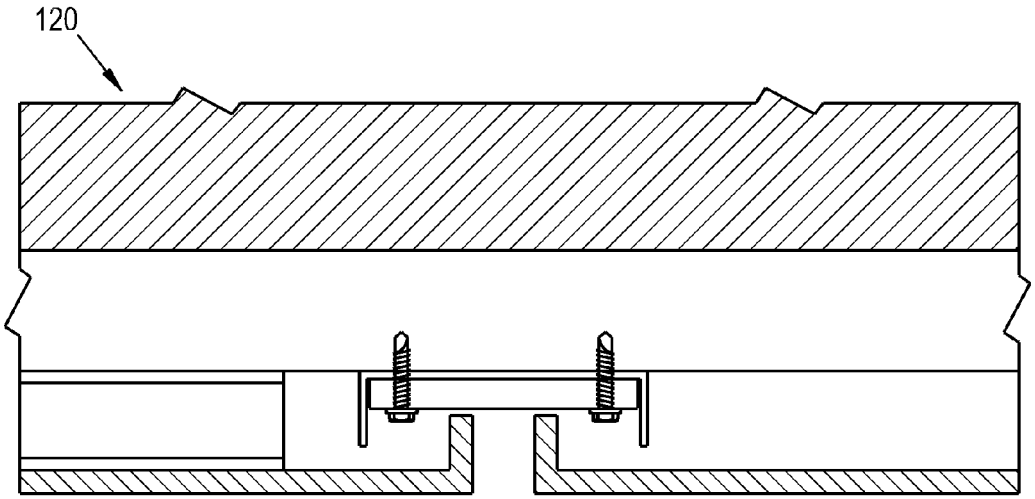
FIG. 18 is a cross-sectional view of the embodiment shown in FIG. 17 taken along a line perpendicular to the view shown in FIG. 17.
Figure 19:
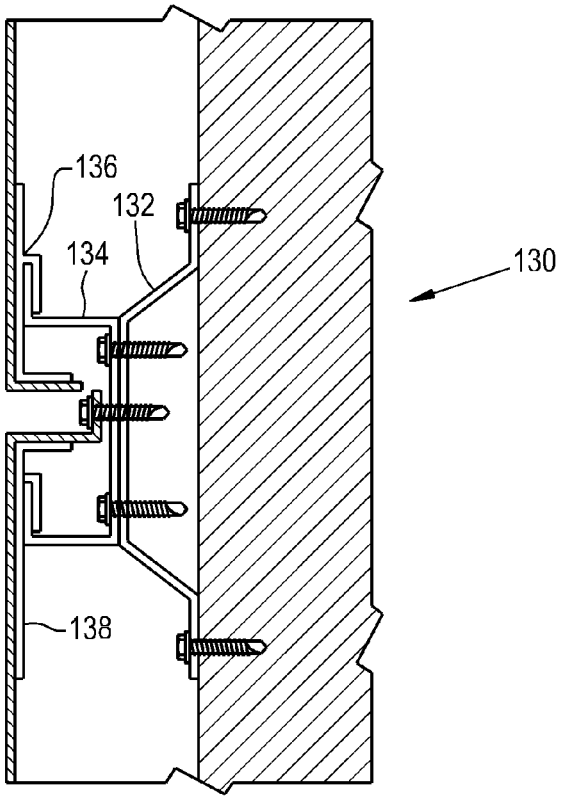
FIG. 19 is a cross-sectional view of yet another embodiment of the present invention.
Figure 20:
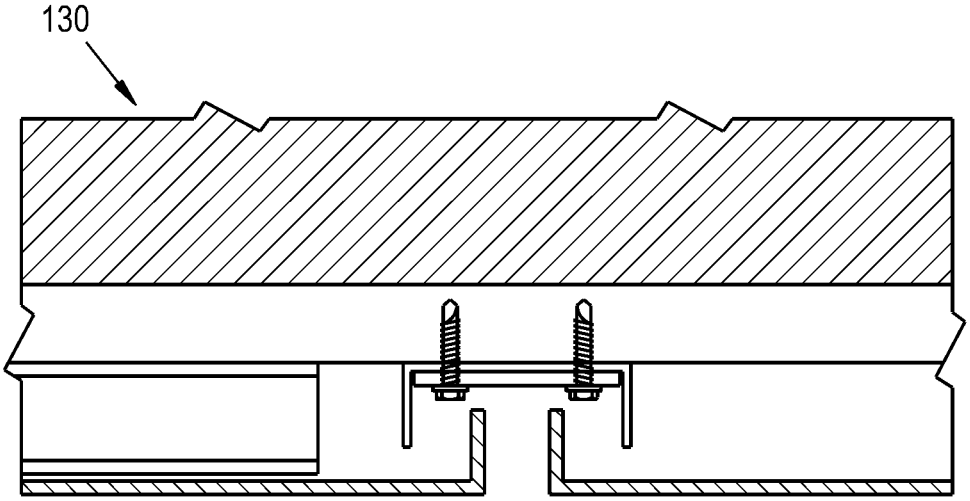
FIG. 20 is a cross-sectional view of the embodiment shown in FIG. 19 taken along a line perpendicular to the view shown in FIG. 19.
Figure 21:
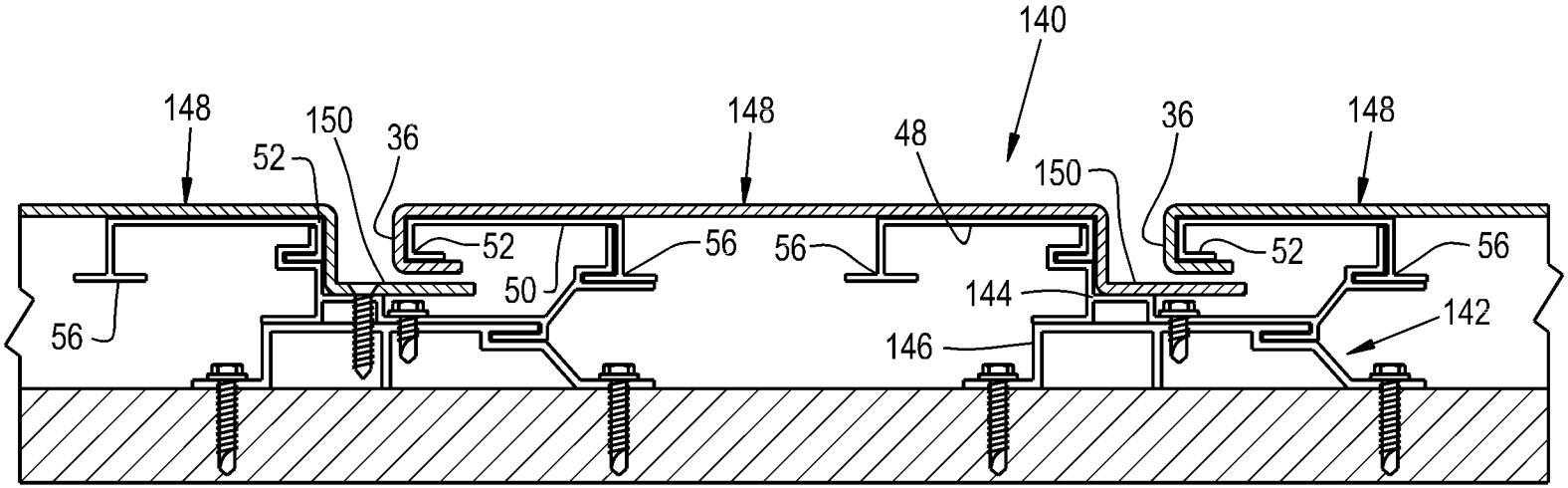
FIG. 21 is a cross-sectional view of yet another embodiment of the present invention.
Figure 22:
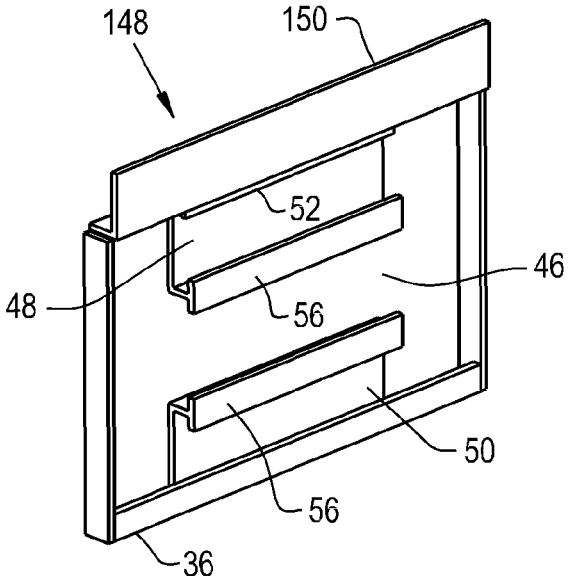
FIG. 22 is a perspective view of a wall panel shown in FIG. 21.

Referring now to FIGS. 14-16, there is shown yet another embodiment of a wall panel system 100 of the present invention. Mounting rails 102 are fastened to metal studs 104, which in turn are fastened to the building surface 12. Mounting rails 102 extend between vertical supports 106, and together define a panel mounting gridwork (not numbered) to which the wall panels 112 are attached. Each mounting rail 102 includes an upper mounting feature 108 and a lower mounting feature 110 which mates with corresponding extrusions at the rear surface of a wall panel 112 (FIG. 16).

Referring to FIGS. 17-18 and 19-20, two additional embodiments of wall panel systems 120 and 130 of the present invention are shown. The cross-sectional shapes of extrusions 122, 124, 126 and 128 used in wall panel system 120 and extrusions 132, 134, 136 and 138 used in wall panel system 130 differ from those described above with respect to other embodiments of wall panel systems 10, 80, and 100 of the present invention. However, the general concept of using extrusions with upper and lower mounting features for each of the mounting rails and the wall panels is the same.

Referring now to FIGS. 21-22 and 24-25, another embodiment of a wall panel system 140 is shown that is similar to previously shown wall panels systems 10, 80, 100, 120 and 130, but has a mounting rail 142 with extrusions 144 (shown in greater detail in FIG. 24) and 146 (shown in greater detail in FIG. 25) that have a different cross-sectional shape than previously described extrusions. Wall panels 148 shown are similar to wall panels 14 shown in FIGS. 1 and 6, with the notable exception being that a vertical extension 150 of the wall panel 148 does not curve slightly behind a return flange 36 of an adjacent panel 148. It should therefore be appreciated that the extrusions attached to the rear surface of the panels and the upper and lower mounting features of the mounting rails of the present invention can be readily modified with the teachings disclosed herein to create many different configurations of wall panel systems that leave a gap between adjacent wall panels and can be mounted non-sequentially.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wall panel system for attachment to a building surface, said wall panel system comprising:

a plurality of generally vertical supports;

a plurality of generally horizontal mounting rails interconnected with said vertical supports to define a panel mounting gridwork, said horizontal mounting rails having an upper mounting feature and a lower mounting feature on a side opposite from the building surface; and a plurality of panels, each said panel having a rear surface, an upper extrusion mounted to a top of said rear surface, and a lower extrusion mounted to a bottom of said rear surface, said upper extrusion mating with a corresponding lower mounting feature on said gridwork, and said lower extrusion mating with a corresponding upper mounting feature on said gridwork, said plurality of panels having a gap about a periphery thereof relative to any adjacent panels, whereby said panels can be non-sequentially mounted to said gridwork, each said panel including an outer surface opposed to said rear surface and a top return flange and a bottom return flange that both extend at an approximate 90° angle relative to said outer surface, said top return flange extending farther than said bottom return flange.

2. The wall panel system of claim 1, wherein each of said upper mounting feature and said lower mounting feature include a recess, and wherein each of said upper extrusion and said lower extrusion include a projection which mates within a corresponding recess.

3. The wall panel system of claim 2, wherein each of said upper extrusion and said lower extrusion are identical.

4. The wall panel system of claim 1, wherein each said panel includes a pair of side extrusions mounted to respective side edges of said rear surface.

5. The wall panel system of claim 4, wherein said upper extrusion, said lower extrusion and said pair of side extrusions are substantially identical.

6. The wall panel system of claim 1, wherein said panels may be mounted to said gridwork without the use of tools.

7. The wall panel system of claim 1, wherein each said mounting rail includes a first extrusion attached to the building surface and a second extrusion connected to said first extrusion.

8. The wall panel system of claim 7, wherein said first extrusion includes a standoff that abuts the building surface.

9. The wall panel system of claim 7, wherein said upper mounting feature and said lower mounting feature are a part of said second extrusion.

10. The wall panel system of claim 1, wherein said top return flange includes a vertical extension plate that extends upward.

11. The wall panel system of claim 10, wherein said vertical extension plate curves behind a bottom return flange of an adjacent panel but does not contact the rear surface of said adjacent panel.

12. A method of building a wall panel system on a panel mounting gridwork including a plurality of mounting rails, each said mounting rail including a lower mounting feature and an upper mounting feature, including the steps of:

providing a plurality of panels, each said panel having a rear surface, an upper extrusion mounted to a top of said rear surface, a lower extrusion mounted to a bottom of said rear surface, an outer surface opposed to said rear surface, and a top return flange and a bottom return flange that both extend at an approximate 90° angle relative to said outer surface, said top return flange extending farther than said bottom return flange;

mounting a first panel to a first mounting rail and a second mounting rail adjacent to said first mounting rail on said gridwork; and mounting a second panel to said second mounting rail such that a gap is formed between said first panel and said second panel, wherein said mounting steps can be performed non-sequentially.

13. The method according to claim 12, wherein said mounting of said first panel is performed by mating an upper extrusion of said first panel with a corresponding lower mounting feature of said first mounting rail and mating a lower extrusion of said first panel with a corresponding upper mounting feature of said second mounting rail.

14. The method according to claim 12, wherein said mounting of said second panel is performed by mating an upper extrusion of said second panel with a corresponding lower mounting feature of said second mounting rail and mating a lower extrusion of said second panel with a corresponding upper mounting feature of a third mounting rail adjacent to said second mounting rail.

15. The method according to claim 12, wherein each of said upper extrusions and said lower extrusions are identical.

* * * * *